US008882531B2

(12) United States Patent
Kuo et al.

(10) Patent No.: US 8,882,531 B2
(45) Date of Patent: Nov. 11, 2014

(54) RETAINING ELEMENT FOR SECURING A PLUG TO A CONNECTOR MOUNTED ON A PRINTED CIRCUIT BOARD

(71) Applicant: Wistron Corporation, New Taipei (TW)

(72) Inventors: Wei Ching Kuo, New Taipei (TW); Chuan Hsiao Chiu, New Taipei (TW); Ting Fang Lai, New Taipei (TW)

(73) Assignee: Wistron Corporation, New Taipei (TW)

( * ) Notice: Subject to any disclaimer, the term of this patent is extended or adjusted under 35 U.S.C. 154(b) by 94 days.

(21) Appl. No.: 13/852,269

(22) Filed: Mar. 28, 2013

(65) Prior Publication Data

US 2013/0344709 A1 Dec. 26, 2013

(30) Foreign Application Priority Data

Jun. 22, 2012 (TW) ..... 101212088 U

(51) Int. Cl.
*H01R 13/62* (2006.01)
*H01R 12/72* (2011.01)

(52) U.S. Cl.
CPC ..... *H01R 13/62* (2013.01); *H01R 12/724* (2013.01)
USPC ..... 439/372

(58) Field of Classification Search
CPC ..... H01R 13/447; H01R 13/639; H01R 13/5213; H01R 13/6275; H01R 13/6392; H01R 13/6395
See application file for complete search history.

(56) References Cited

U.S. PATENT DOCUMENTS

| | | | | |
|---|---|---|---|---|
| 8,500,481 | B2 * | 8/2013 | Lin et al. | 439/372 |
| 8,777,656 | B2 * | 7/2014 | Kuo et al. | 439/372 |
| 2005/0078819 | A1 | 4/2005 | Hsu et al. | |
| 2010/0248554 | A1 | 9/2010 | Hung et al. | |
| 2013/0034985 | A1 * | 2/2013 | Lin et al. | 439/347 |
| 2013/0059454 | A1 * | 3/2013 | Cheng et al. | 439/135 |
| 2013/0072042 | A1 * | 3/2013 | Liao | 439/142 |
| 2013/0130524 | A1 * | 5/2013 | Wang | 439/142 |
| 2013/0260581 | A1 * | 10/2013 | Kuo et al. | 439/138 |

* cited by examiner

*Primary Examiner* — Chandrika Prasad
(74) *Attorney, Agent, or Firm* — John A. Fortkort; Fortkort & Houston P.C.

(57) ABSTRACT

This disclosure relates to an electrical connector module and an electronic device including the same. The electrical connector module includes: a circuit board formed with two lateral notches and a main notch interposed therebetween; an electrical connector mounted on the circuit board and including an insulating housing; and a retaining element including: two support arms respectively formed on the circuit board relative to the lateral notches; two flexible connecting arms respectively extending from the support arms through the lateral notches; and an engaging seat connected between the flexible connecting arms and suspended under the main notch so as to cooperate with the insulating housing to define a plugging space.

18 Claims, 5 Drawing Sheets

RETAINING ELEMENT FOR SECURING A PLUG TO A CONNECTOR MOUNTED ON A PRINTED CIRCUIT BOARD

CROSS REFERENCE TO RELATED APPLICATION

This application claims priority of Taiwanese Patent Application No. 101212088 filed on Jun. 22, 2012, the disclosure of which is incorporated herein by reference.

BACKGROUND OF THE DISCLOSURE

1. Field of the Disclosure

The disclosure relates to an electrical connector module, more particularly to an electrical connector module including a half-socket-type electrical connector and an electronic device including the electrical connector module.

2. Description of the Related Art

Most of currently available portable electronic devices are developed to trend toward a thin and lightweight design. One example is the ultra-thin notebook computer (ultrabook) having an overall thickness that has been greatly reduced. Generally, a connector socket disposed at a side of an electronic device is designed to a half-socket type so as to comply with the slim body requirement of the electronic device. That is to say, the housing of such connector socket, compared with a conventional connector socket, is only half in height so as to reduce the overall height of the electronic device. For example, U.S. Patent Application Publication No. 2010/0248554A has disclosed a portable electronic device and a halved connector socket useful for the same. The halved connector socket has to cooperate with a casing of the electronic device so as to define a space for a connector plug to plug thereinto, and to secure the connector plug. Thereby, the connector plug is stably and electrically connected to the connector socket.

In the disclosure of the above U.S. application publication, the casing of the electronic device has a bottom wall additionally mounted with a movable element at a position that corresponds to the connector socket. The movable element is connected pivotally to the bottom wall, and is able to abut against the connector plug when the connector plug by an elastic force generated by a torsion spring when the connector plug is plugged in the connector socket so as to secure the connector plug. Consequently, the connector plug is able to be stably and electrically connected to the connector socket when it is not pulled out from the space.

However, the assembling manner of the movable element and the bottom wall is relatively complicated and thus, there is still a room for improvement.

SUMMARY

Therefore, one object of the present disclosure is to provide an electrical connector module that is able to be easily assembled.

Another object of this disclosure is to provide an electronic device that includes the electrical connector module.

Therefore, the electronic device of this disclosure includes a casing and an electrical connector module. The casing includes a side casing wall and a bottom casing wall, and has an opening. The bottom casing wall has a base portion and an inclined portion. The base portion is disposed perpendicular to the side casing wall. The inclined portion connects the base portion and the side casing wall and is beveled. The opening is formed in the side casing wall and the inclined portion of the bottom casing wall. The electrical connector module is mounted in the casing at a position corresponding to the opening, and is adapted for a connector plug to be plugged thereinto and to be electrically connected therewith. The electrical connector module includes a circuit board, an electrical connector and a retaining element. The circuit board is formed with a main notch and two lateral notches, and the main notch is located between the two lateral notches. All of the main notch and the lateral notches are indented inwardly from a same side of the circuit board, and the side of the circuit board is disposed proximate to the side casing wall. The main notch is in spatial communication with the portion of the opening formed in the side casing wall. The electrical connector is mounted on the circuit board and includes an insulating housing and a plurality of pins. The insulating housing has two opposite side walls and a top wall connected between top ends of the side walls. The top wall and the side walls cooperate to form an inverted U shape. Bottom ends of the side walls are coupled to the circuit board so that the top wall is corresponds in position to and is disposed above and spaced apart from the main notch. The pins are mounted on the insulating housing and are electrically connected with the circuit board. The retaining element includes a pair of support arms, a pair of flexible connecting arms and an engaging seat. Each of the support arms is mounted on the circuit board relative to a corresponding one of the lateral notches and is partially disposed thereabove. Each of the flexible connecting arms extends downwardly from a corresponding one of the support arms through a corresponding one of the lateral notches. The engaging seat is connected between the flexible connecting arms and is suspended under the main notch so as to cooperate with the insulating housing to define a plugging space adapted for the connector plug to plug thereinto. The engaging seat covers up the portion of the opening formed in the bottom casing wall and appears to be integrated with the bottom casing wall as one piece. The engaging seat is capable of flexibly engaging the connector plug. When the connector plug is plugged into the plugging space, the engaging seat is pushed downwardly and each of the flexible connecting arms stores a restoring force to urge the engaging seat to abut against the connector plug.

The effect of this disclosure resides in that the retaining element can be mounted on the circuit board by a relatively easy and convenient operation, and is capable of cooperating with the electrical connector to facilitating plugging of the connector plug so as for the connector plug to form an electrical connection with the electrical connector. The requirements of engaging firmly the connector plug and maintaining the overall aesthetic appeal of the casing are both met.

BRIEF DESCRIPTION OF THE DRAWINGS

Other features and advantages of the present disclosure will become apparent in the following detailed description of the embodiment with reference to the accompanying drawings, of which.

DETAILED DESCRIPTION OF THE EMBODIMENT

Figure 1:
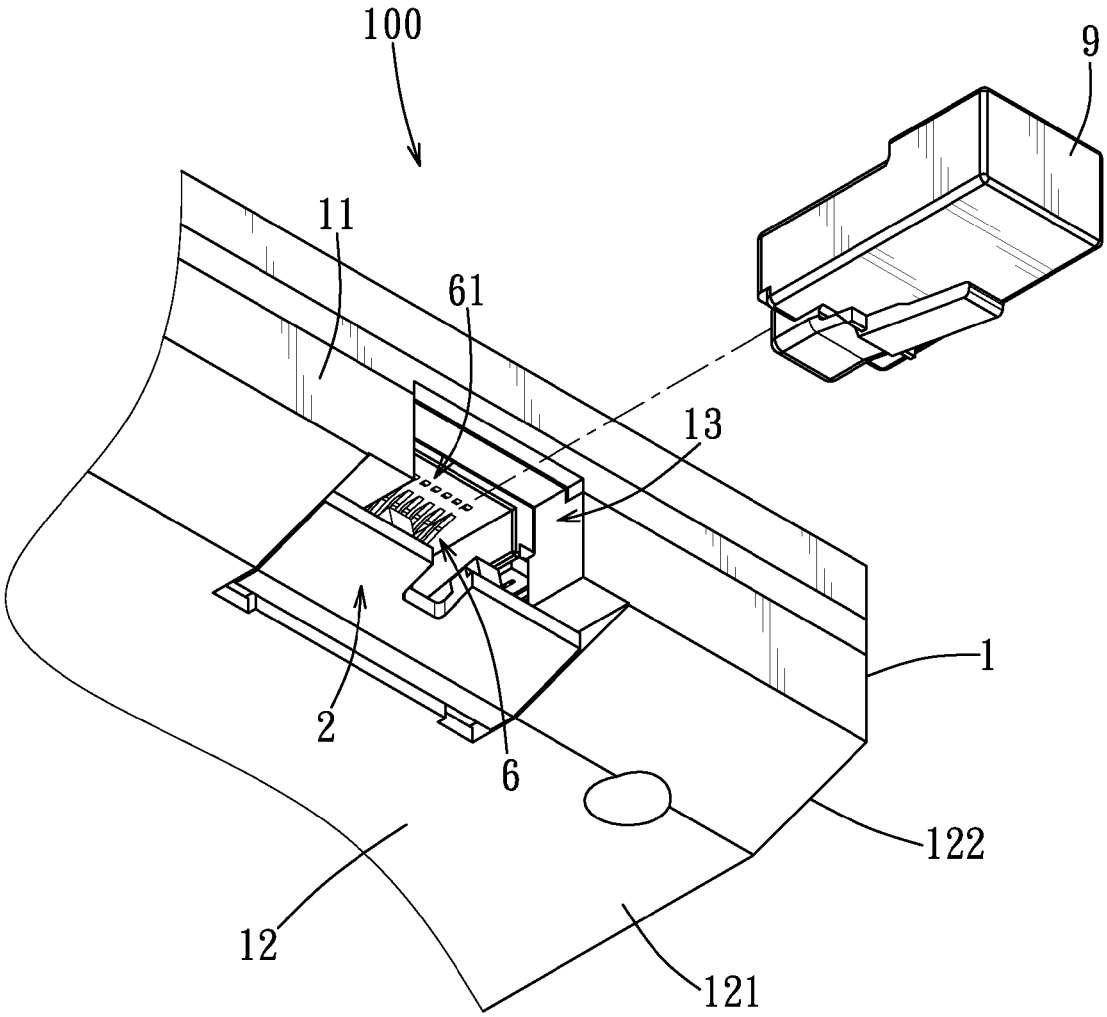
FIG. 1 is a fragmentary perspective view illustrating the embodiment of an electronic device with an electrical connector module according to the present disclosure in an assembled state, as well as a connector plug.
Figure 2:
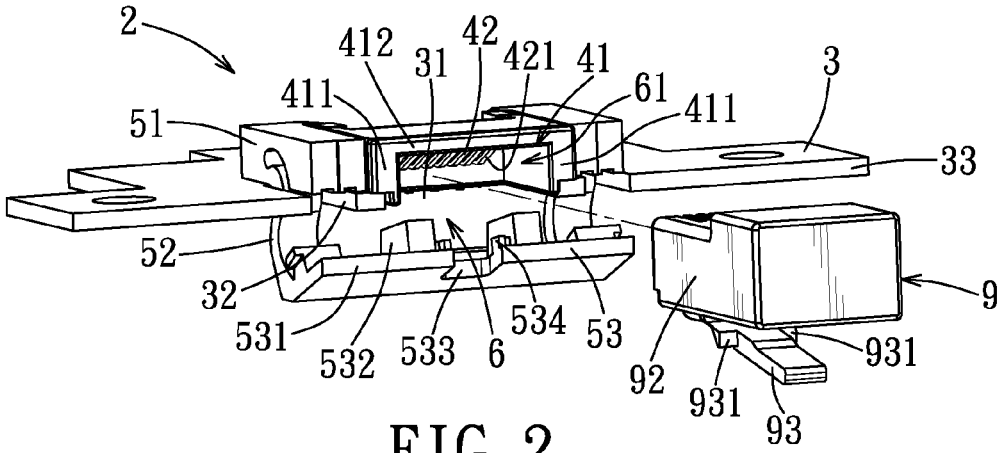
FIG. 2 is a perspective view illustrating the corresponding relationship of the electrical connector module of the embodiment and the connector plug.
Figure 3:
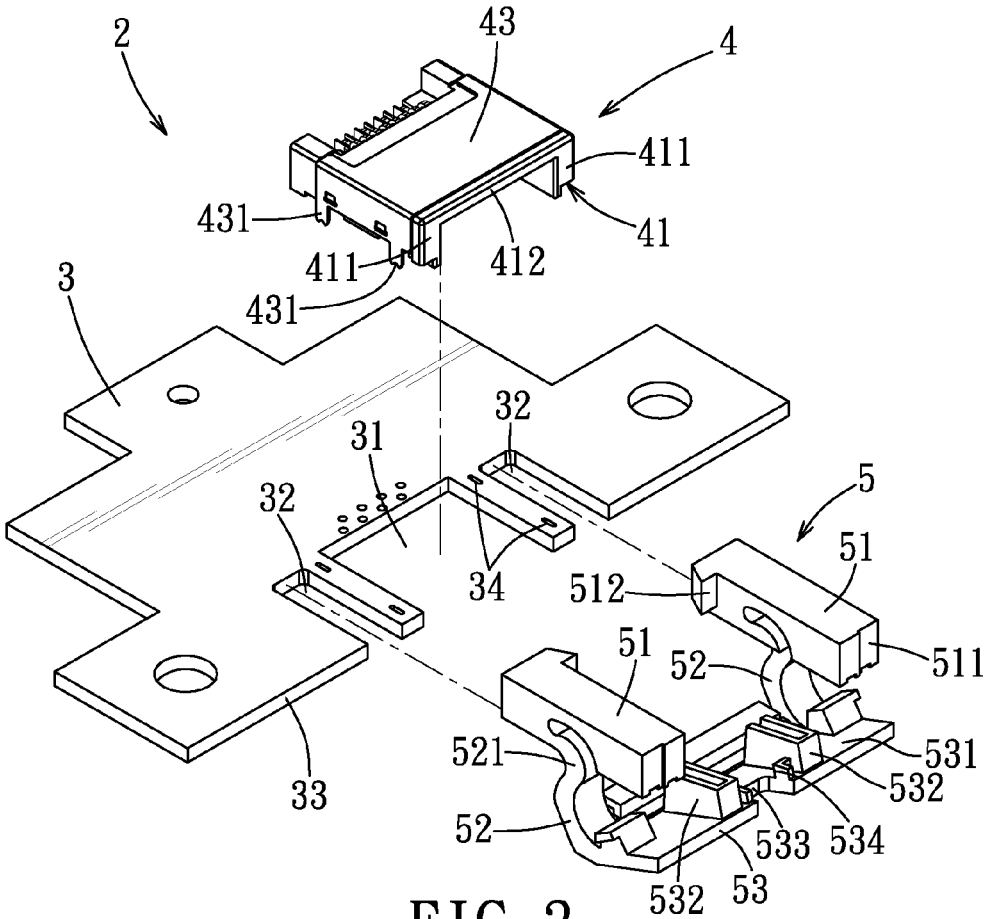
FIG. 3 is an exploded perspective view illustrating components of the electrical connector module.

Referring to FIGS. 1 to 3, the embodiment of an electronic device 100 according to this disclosure includes a casing 1 and an electrical connector module 2. In this embodiment, the electronic device 100 is exemplified by an ultrabook.

The casing 1 includes a side casing wall 11 and a bottom casing wall 12 interconnected with each other, and is formed with an opening 13. The bottom casing wall 12 has a base portion 121 and an inclined portion 122. The base portion 121 is disposed perpendicular to the side casing wall 11. The inclined portion 122 connects the base portion 121 and the side casing wall 11 and is beveled. The opening 13 is formed in the side casing wall 11 and the inclined portion 122 of the bottom casing wall 12.

The electrical connector module 2 is mounted in the casing 1 at a position corresponding to the opening 13. The electrical connector module 2 is adapted to have a connector plug 9 plugged therein and to be electrically connected therewith. The electrical connector module 2 includes a circuit board 3, an electrical connector 4 and a retaining element 5.

The circuit board 3 is formed with a main notch 31 and two lateral notches 32 that interpose the main notch 31 therebetween. The main notch 31 has an opening size larger than those of the two lateral notches 32. All of the main notch 31 and the lateral notches 32 are indented inwardly from a same side 33 of the circuit board 3. The side 33 of the circuit board 3 is disposed proximate to the side casing wall 11, and the main notch 31 is in spatial communication with the portion of the opening 13 formed in the side casing wall 11. That is to say, the main notch 31 opens toward the side casing wall 11 and is in spatial communication with the opening 13.

Figure 4:
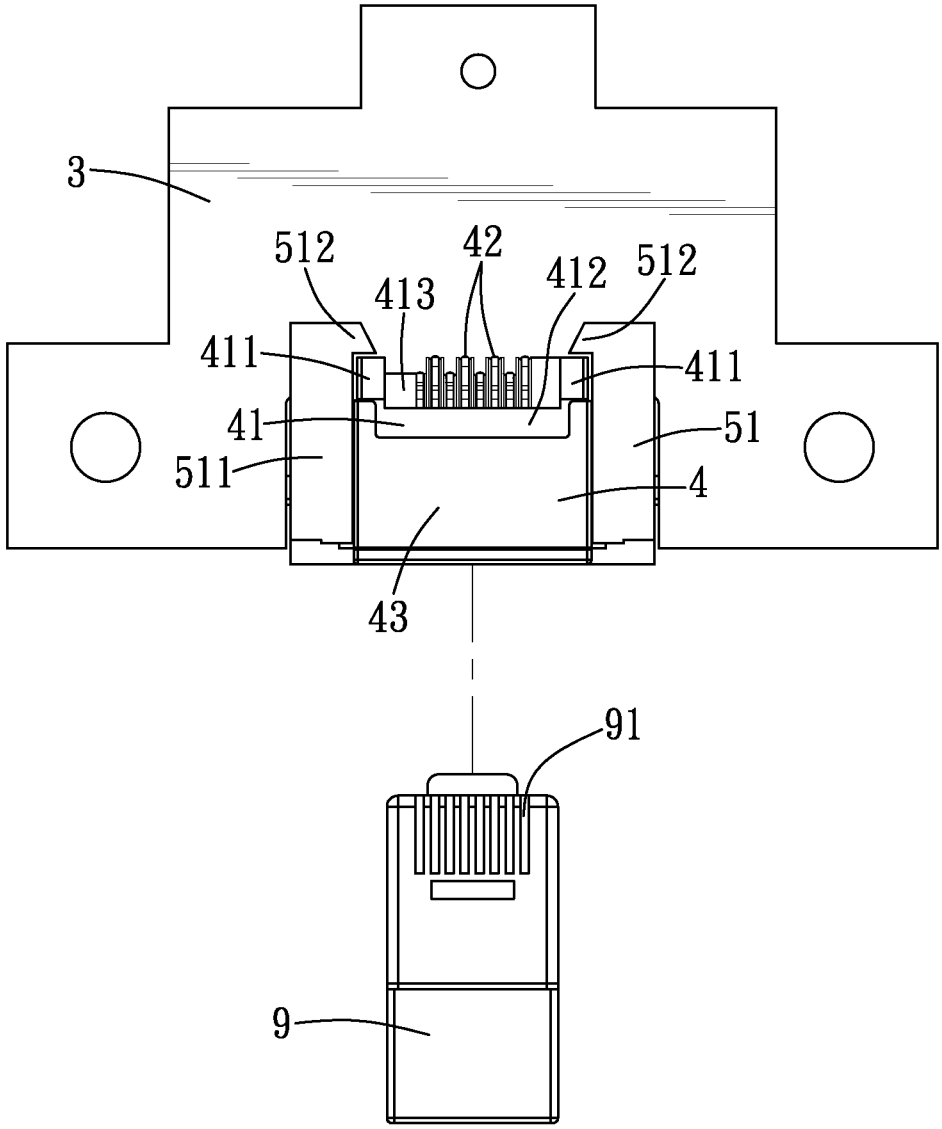
FIG. 4 is the top view of the electrical connector module and the connector plug.
Figure 5:
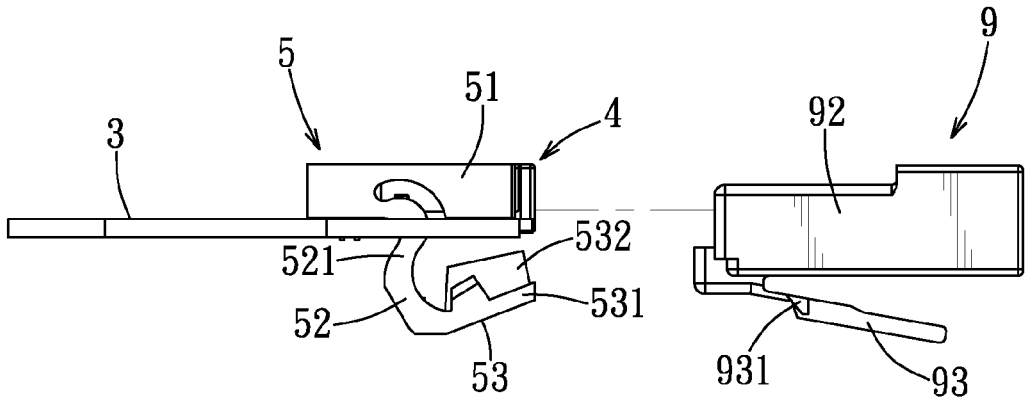
FIG. 5 is a side view illustrating the assembling relationship of a retaining element and a circuit board of the electrical connector module and the connector plug.

Referring to FIGS. 2 to 4, the electrical connector 4 is mounted on the circuit board 3 and includes an insulating housing 41, a plurality of pins 42, and a metal cover 43. The insulating housing 41 includes two opposite side walls 411, a top wall 412 and a rear wall 413. Each of the side walls 411 has a top end and a bottom end opposite to the top end. The top wall 412 is connected between the top ends of the side walls 411, and the top wall 412 and the side walls 411 cooperate to form an inverted U shape. The bottom ends of the side walls 411 are coupled to the circuit board 3 such that the top wall 412 corresponds in position to the main notch 31, and is disposed above and spaced apart from the main notch 31. The rear wall 413 is connected to the side walls 411 and the top wall 412. That is to say, the insulating housing 41 is mounted on the circuit board 3 and covers the main notch 31. The pins 42 are mounted on the insulating housing 41 and penetrate the rear wall 413 so as to be soldered and electrically connected to the circuit board 3. The metal cover 43 covers the top wall 412 and the side walls 411 of the insulating housing 41 and is soldered fixedly to the circuit board 3. In detail, each of the pins 42 has a contact portion 421 and a soldering portion 422 (referring to FIG. 6). The contact portion 421 is disposed below the top wall 412, and is used in contact with a corresponding one of a plurality of pins 91 of the connector plug 9. The soldering portion 422 of each pin 42 extends out of the insulating housing 41 so as to be soldered to the circuit board 3. The metal cover 43 has two opposite lateral sides disposed proximate to the side walls 411, respectively. Each of the lateral sides has two insert pieces 431 for respectively inserting into soldering holes 34 formed in the circuit board 3 to be fixedly soldered to the circuit board 3. The metal cover 43 positions the insulating case 41 to correspond to the circuit board 3, and provides an electromagnetic shielding function.

Referring again to FIGS. 1 to 5, the retaining element 5 is integrally made from a plastic material, and includes a pair of support arms 51, a pair of flexible connecting arms 52 and an engaging seat 53. Each of the support arms 51 is mounted on the circuit board 3 relative to a corresponding one of the lateral notches 32 and is partially disposed thereabove. That is to say, each of the support arms 51 covers the corresponding one of the lateral notches 32. Each of the flexible connecting arms 52 extends downwardly from a corresponding one of the support arms 51 through a corresponding one of the lateral notches 32. The engaging seat 53 is connected between the flexible connecting arms 52 and is suspended under the main notch 31 so as to cooperate with the insulating housing 41 to define a plugging space 6 adapted for the connector plug 9 to plug therein. As such, according to the abovementioned definition, the main notch 31 is part of the plugging space 6. In more details, the side walls 411 and a front end of the top wall 412 of the insulating housing 41 cooperates with a front end of the engaging seat 53 to define an entrance 61 to the plugging space 6. The entrance 61 is disposed proximate to the portion of the opening 13 formed in the side casing wall 11, and the rear wall 413 is opposite to the entrance 61.

In this context, the forward and rearward directions used for describing the use of the electrical connector module 2 are defined with reference with the plugging direction of the connector plug 9 with respect to the plugging space 6. That is to say, the direction from the entrance 61 to the rear wall 413 is defined as a direction from front to rear.

Each of the support arms 51 is disposed proximate to a respective one of the side walls 411 and includes a main portion 511 that extends along the lengthwise direction of the corresponding one of the side walls 411 and a retention portion 512 that extends transversely from the main portion 511 in the proximity of a rear end of the corresponding one of the side walls 411. The retention portions 512 of the support arms 51 are respectively restricted by the side walls 411 so as to prevent the support arms 51 from moving forwards. Each of the flexible connecting arms 52 has an S-shaped curved section 521 to increase resilience of the flexible connecting arms 52. The engaging seat 53 includes a main body 531 connected to the flexible connecting arms 52 and a pair of protrusions 532 protruding from the main body 531 toward the insulating housing 41. The protrusions 532 are adapted to abut against the connector plug 9 when the connector plug 9 is plugged in the plugging space 6. In this embodiment, the electrical connector module 2 is an RJ45-type socket, and the connector plug 9 is an RJ45-type network line connector. The connector plug 9 includes a case 92 and a flexible locking arm 93 extending downwardly and inclinedly from a bottom side of the case 92. A free end of the flexible locking arm 93 may be pressured to move toward the case 92, and then return to its original position when the pressure is released. The flexible locking arm 93 has a pair of retreat-hindering portions 931 formed on opposite sides thereof. Specifically, each of the retreat-hindering portions 931 is configured as a shoulder portion that laterally protrudes from the flexible locking arm 93 in the proximity of the case 92. Each of the retreat-hindering portions 931 has an upright plane. Moreover, the main body 531 of the engaging seat 53 is formed with a notch 533 disposed between the protrusions 532, and the engaging seat 53 further includes a pair of blocks 534 extending from the main body 531 and proximate to the notch 533. The notch 533 matches with the flexible locking arm 93 of the connector plug 9 so as to receive the flexible locking arm 93 when the connector plug 9 is plugged into the plugging space 6. When the free end of the flexible locking arm 93 is restored to its original position, i.e., a position that is away from the case 92, the retreat-hindering portions 931 abut against the rear sides of the blocks 534 in such a manner that the connector plug 9 is prevented from escaping from the plugging space 6.

Figure 6:
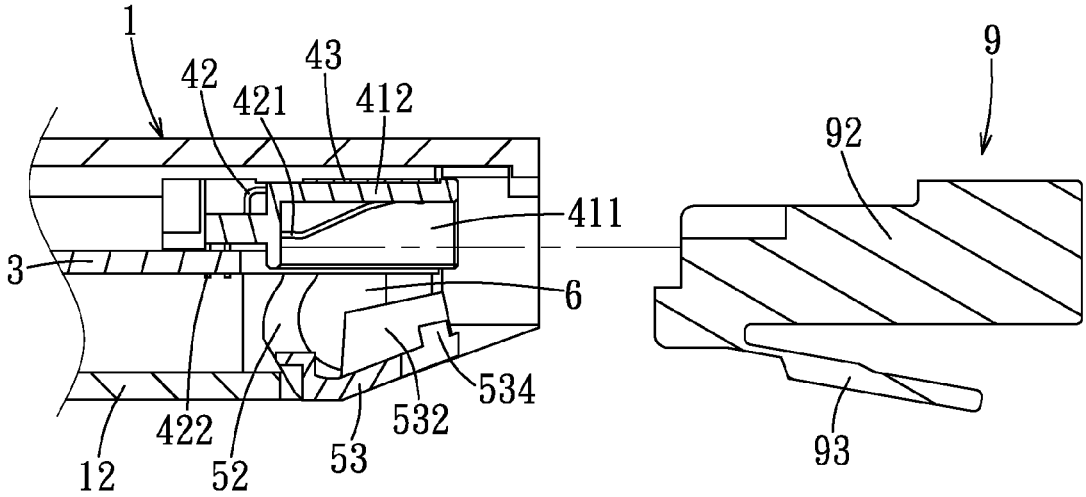
FIGS. 6 to 8 are fragmentary side sectional views illustrating consecutive steps for plugging the connector plug into the electrical connector module of the embodiment.
Figure 7:
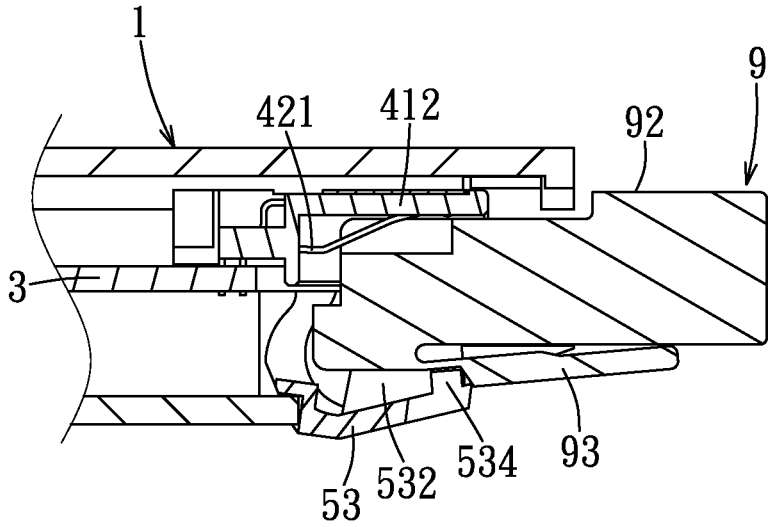
Figure 8:
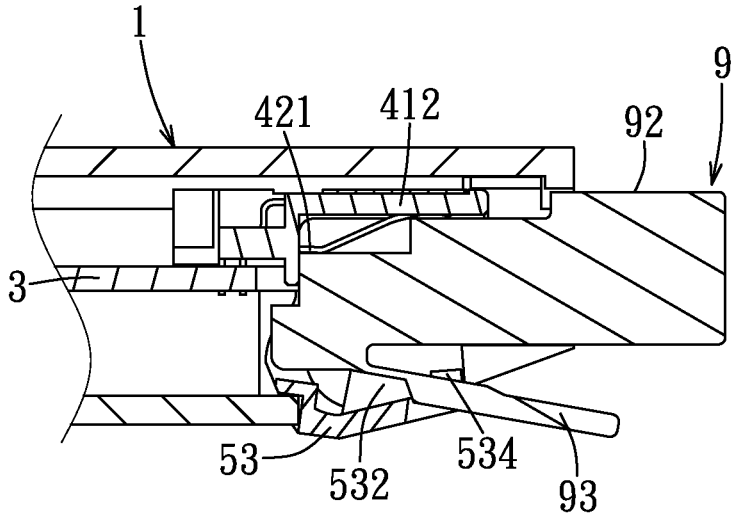

Referring again to FIGS. 1, 2 and 5, the engaging seat 53 is inclined upwardly along the direction from rear to front such that the entrance 61 of the plugging space 6 is narrower than the interior of the plugging space 6. In such a manner, the engaging seat 53 covers up the portion of the opening 13 formed in the bottom casing wall 12 and appears to be integrated with the bottom casing wall 12 as one piece. Referring to FIGS. 6 to 8, when the connector plug 9 is plugged into the plugging space 6, the engaging seat 53 is pushed downwardly and the flexible connecting arms 52 each stores a restoring force to urge the engaging seat 53 to abut against the connector 9. In other words, the engaging seat 53 is capable of flexibly engaging the connector plug 9. Since the flexible connecting arms 52 is relatively flexible, when the connector plug 9 is plugged in the plugging space 6, the entrance 61 is forced to be expanded by the connector plug 9, and in the meantime, the flexible connecting arms 52 are forced to be elastically deformed, generating the restoring forces, and moving linkably the engaging seat 53. Thus, the engaging seat 53 abuts against the connector plug 9 and cooperates with the insulating housing 41 to secure the connector plug 9. Referring to FIGS. 2 and 7, during the process of plugging the connector plug 9 into the plugging space 6, the flexible locking arm 93 of the connector plug 9 is squeezed by the blocks 534 so that the free end thereof moves toward the case 92 and stores a restoring force therein. Referring to FIGS. 2 and 8, after the retreating-hindering portions 931 pass the blocks 534, the force resulting in squeezing the flexible locking arm 93 is released such that the free end of the flexible locking arm 93 is able to move away from the case 92 due to the restoring force and be received in the notch 533 with the retreat-hindering portions 931 abut against the blocks 534, respectively. If it is desired to unplug the connector plug 9 from the plugging space 6, an external force is exerted on the flexible locking arm 93 to move the free end thereof toward the case 92 so as to make the retreat-hindering portions 931 sufficiently distant from the blocks 534 so as to pass thereby. Thus, the connector plug 9 is capable of being disengaged from the retaining element 5 so as to be unplugged from the plugging space 6.

The retaining element 5 has a relatively simple structure and may be integrally formed from a plastic material. Moreover, since the retaining element 5 has no separable parts, assembly of the retaining element 5 is not required when the retaining element 5 is to be mounted on the circuit board 3, only a direct mounting of the retaining element 5 at the appropriate corresponding position to the circuit board 3 is involved. The operation to mount the retaining element 5 on the circuit board 3 is relatively easy and convenient. Furthermore, the position on the circuit board 3 for mounting the retaining element 5 matched the opening 13 of the casing 1 of the electronic device 110 and the engaging seat 53 is integrated with the bottom casing wall 12 in the overall appearance. As such, the requirements of engaging firmly the connector plug 9 and maintaining the overall aesthetic appeal of the casing 1 are both met.

In summary, the retaining element 5 can be mounted on the circuit board 3 by a relatively easy and convenient operation, and is capable of cooperating with the electrical connector 4 to facilitate plugging of the connector plug 9 so as for the connector plug 9 to form electrical connection with the electrical connector 4. In such a manner, the requirements of engaging firmly the connector plug 9 and maintaining the overall aesthetic appeal of the casing 1 are both met. Therefore, the purpose of this disclosure is served.

While the present disclosure has been described in connection with what is considered the practical embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An electrical connector module adapted for a connector plug to plug thereinto and to be electrically connected therewith, the electrical connector module comprising:

a circuit board formed with a main notch and two lateral notches interposing said main notch therebetween, each of said main notch and said lateral notches being indented inwardly from a same side of said circuit board;

an electrical connector mounted on said circuit board and including an insulating housing and a plurality of pins, said insulating housing including two opposite side walls and a top wall, each of said side walls having a top end and a bottom end opposite to said top end, said top wall being connected between said top ends of said side walls, said top wall and said side walls cooperating to form an inverted U shape, said bottom ends of said side walls being coupled to said circuit board so that said top wall corresponds in position, and is disposed above and spaced apart from said main notch, said pins being mounted on said insulating housing and being electrically connected to said circuit board; and a retaining element including a pair of support arms, a pair of flexible connecting arms and an engaging seat, each of said support arms being mounted on said circuit board relative to a corresponding one of said lateral notches and being partially disposed thereabove, each of said flexible connecting arms extending from a corresponding one of said support arms through a corresponding one of said lateral notches, said engaging seat being connected between said flexible connecting arms and being suspended under said main notch so as to cooperate with said insulating housing to define a plugging space adapted for the connector plug to plug therein, said engaging seat being capable of flexibly engaging with the connector plug by means of restoring forces originating from said flexible connecting arms.

2. The electrical connector module as claimed in claim 1, wherein each of said flexible connecting arms has an S-shaped curved section.

3. The electrical connector module as claimed in claim 1, wherein said side walls and a front end of said top wall cooperate with a front end of said engaging seat to define an entrance to said plugging space, each of said support arms being disposed proximate to a corresponding one of said side walls and includes a main portion that extends along a lengthwise direction of the corresponding one of said side walls and a retention portion that extends transversely from said main portion in the proximity of a rear end of the corresponding one of said side walls.

4. The electrical connector module as claimed in claim 3, wherein said engaging seat is inclined upwardly along a direction from rear to front such that said entrance to said plugging space is narrower than an interior of said plugging space.

5. The electrical connector module as claimed in claim 4, wherein said engaging seat includes a main body that is connected to said flexible connecting arms and a pair of protrusions that protrude from said main body toward said insulating housing, said protrusions being able to abut against the connector plug when the connector plug is plugged into said plugging space.

6. The electrical connector module as claimed in claim 3, wherein said insulating housing further includes a rear wall that is connected to said side walls and said top wall and that faces said entrance, said pins penetrating said rear wall so as to be soldered to said circuit board.

7. The electrical connector module as claimed in claim 1, wherein said retaining element is integrally made from a plastic material.

8. The electrical connector module as claimed in claim 1, wherein said electrical connector further includes a metal cover that covers said top wall and said side walls of said insulating housing and that is soldered fixedly to said circuit board.

9. The electrical connector module as claimed in claim 5, wherein said electrical connector module is an RJ45-type socket, and wherein said main body of said engaging seat is further formed with a notch disposed between said protrusions, said engaging seat further includes a pair of blocks that extend from said main body and that are disposed proximate to said notch.

10. An electronic device, comprising:

a casing that includes a side casing wall and a bottom casing wall and that has an opening, said bottom casing wall having a base portion and an inclined portion, said base portion being disposed perpendicular to said side casing wall, said inclined portion connecting said base portion and said side casing wall and being beveled, said opening being formed in said side casing wall and said inclined portion of said bottom casing wall; and an electrical connector module that is mounted in said casing at a position corresponding to said opening, and that is adapted for a connector plug to be plugged thereinto and to be electrically connected therewith, said electrical connector module including a circuit board formed with a main notch and two lateral notches interposing said main notch therebetween, each of said main notch and said lateral notches being indented inwardly from a same side of said circuit board, an electrical connector mounted on said circuit board and including an insulating housing and a plurality of pins, said insulating housing including two opposite side walls and a top wall, each of said side walls having a top end and a bottom end opposite to said top end, said top wall being connected between said top ends of said side walls, said top wall and said side walls cooperating to form an inverted U shape, said bottom ends of said side walls being coupled to said circuit board so that said top wall corresponds in position to and is disposed above and spaced apart from said main notch, said pins being mounted on said insulating housing and being electrically connected to said circuit board, and a retaining element including a pair of support arms, a pair of flexible connecting arms and a engaging seat, each of said support arms being mounted on said circuit board relative to a corresponding one of said lateral notches and being partially disposed thereabove, each of said flexible connecting arms extending from a corresponding one of said support arms through a corresponding one of said lateral notches, said engaging seat being connected between said flexible connecting arms and being suspended under said main notch so as to cooperate with said insulating housing to define a plugging space adapted for the connector plug to plug thereinto, said engaging seat being capable of flexibly engaging with the connector plug by means of restoring forces originating from said flexible connecting arms.

11. The electronic device as claimed in claim 10, wherein each of said flexible connecting arms has an S-shaped curved section.

12. The electronic device as claimed in claim 10, wherein said side walls and a front end of said top wall cooperate with a front end of said engaging seat to define an entrance to said plugging space, each of said support arms being disposed proximate to a corresponding one of said side walls and includes a main portion that extends along a lengthwise direction of the corresponding one of said side walls and a retention portion that extends transversely from said main portion in the proximity of a rear end of the corresponding one of said side walls.

13. The electronic device as claimed in claim 12, wherein said engaging seat is inclined upwardly along a direction from rear to front such that said entrance to said plugging space is narrower than an interior of said plugging space.

14. The electronic device as claimed in claim 13, wherein said engaging seat includes a main body that is connected to said flexible connecting arms and a pair of protrusions that protrude from said main body toward said insulating housing, said protrusions being able to abut against the connector plug when the connector plug is plugged in said plugging space.

15. The electronic device as claimed in claim 12, wherein said insulating housing further includes a rear wall that is connected to said side walls and said top wall and that faces said entrance, said pins penetrating said rear wall so as to be soldered to said circuit board.

16. The electronic device as claimed in claim 10, wherein said retaining element is integrally made from a plastic material.

17. The electronic device as claimed in claim 10, wherein said electrical connector further includes a metal cover that covers said top wall and said side walls of said insulating housing and that is soldered fixedly to said circuit board.

18. The electronic device as claimed in claim 14, wherein said electrical connector module is an RJ45-type socket, and wherein said main body of said engaging seat is further formed with a notch disposed between said protrusions, said engaging seat further includes a pair of blocks that extend from said main body and that are disposed proximate to said notch.

* * * * *